United States Patent [19]

Baumgartner et al.

[11] Patent Number: 4,541,725

[45] Date of Patent: Sep. 17, 1985

[54] PERPETUAL CALENDAR MECHANISM COMPRISING A FOUR YEAR CYCLE INDICATOR

[75] Inventors: Louis Baumgartner, Le Sentier; Philippe Meylan, L'Orient, both of Switzerland

[73] Assignee: Omega SA, Bienne, Switzerland

[21] Appl. No.: 641,122

[22] Filed: Aug. 15, 1984

[30] Foreign Application Priority Data

Aug. 30, 1983 [CH] Switzerland ..... 4748/83

[51] Int. Cl.[4] ..... G04B 19/24

[52] U.S. Cl. ..... 368/37

[58] Field of Search ..... 368/28, 37, 34–35

[56] References Cited

U.S. PATENT DOCUMENTS 3,628,322 12/1971 McDuffee ..... 368/28

4,427,300 1/1984 Groothuis ..... 368/37

OTHER PUBLICATIONS

B. Humbert, "Modern Calendar Watches", Edition Scriptar S.A., Lausanne (Switzerland) 1954, pp. 41–42.

*Primary Examiner*—Vit W. Miska

*Attorney, Agent, or Firm*—Griffin, Branigan & Butler

[57] ABSTRACT

The perpetual calendar mechanism of the invention comprises in addition to the months indicator a four year cycle indicator which displays successively the normal years and the leap-year. The four year cycle indicator is controlled directly or indirectly by a rotatable assembly journalled on the month star such assembly including a year cam and a Maltese cross enabling it to effect one revolution every four years. In one variant illustrated the mechanism includes a first ring bearing the year indications and a second ring concentric to the first ring bearing an index marker. At each year change the index marker is shifted a quarter turn relative to the indications borne by the first ring.

4 Claims, 5 Drawing Figures

PERPETUAL CALENDAR MECHANISM COMPRISING A FOUR YEAR CYCLE INDICATOR

This invention concerns a perpetual calendar mechanism for a timepiece comprising a month star effecting one revolution per year, a month cam fixed to the month star and provided with full radius sectors corresponding to 31-day months, shallow notches corresponding to 30-day months and an opening situated between the full radius sectors corresponding to January and March, a rotatable assembly journalled on the month star which includes a year cam arranged to rotate once every four years, said year cam providing four surfaces appearing successively in said opening, a month indicator and a four-year cycle indicator.

BACKGROUND OF THE INVENTION

In complex mechanical watches, there exist mainly two well-known forms of perpetual calendar mechanism. One may readily recognize the first of these mechanisms by a small dial bearing the names of the months for four years and which is swept by a month hand. The hand thus makes one revolution in four years. This arrangement permits firstly to recognize that there is a perpetual calendar and thereafter to know immediately to which year the watch has been set relative to the leap-year. The second mechanism corresponds to the general definition given hereinabove where the month indicator makes one revolution per year. In this case however there is nothing to indicate that one is concerned with a perpetual calendar watch and furthermore it is not possible to know off-hand whether the watch is correctly set relative to the leap-year if it is not provided with an additional indicator of the four year cycle.

Such an additional indicator may be found for example in the movement bearing number 861 389 of the manufacturer Patek-Philippe. In this construction the month star bearing the month hand and making one revolution per year controls a reducing gear train which drives a year hand to effect one revolution in four years, the axis of the year hand being coaxial to the month hand. It will be understood however that this system is complicated and above all is likely to require considerable space in the thickness dimension.

SUMMARY OF THE INVENTION

It has been seen above that in the second type of mechanism the month star is provided with a rotatable assembly which is journalled thereon and which includes a year cam arranged to effect one revolution in four years. This invention makes use of this arrangement by having the four year cycle indication depend not on the rotation of the month star but on the position of the year cam, this leading to a simplified construction taking up less space. The means employed include a month star effecting one revolution per year, a month cam fixed to the month star and exhibiting full radius segments corresponding to thirty-one day months, shallow notches corresponding to thirty day months and an opening between the full radius segments corresponding to January and March, a rotatable assembly journalled on the month star and including a year cam arranged to effect one revolution every four years, said year cam exhibiting four sides which appear successively in said opening, a month indicator, and a four year cycle indicator said cycle indicator being controlled by said turning means. A first variant of the invention further provides a first ring fixed to the month star, the month indicator comprising a hand borne by a pipe fixed to said star, the four-year cycle indicator comprising a second ring fixed to a pinion journalled on said pipe, said second ring being able to turn freely within said first ring and said pinion being arranged to mesh with teeth borne by the turning means journalled on the star.

DETAILED DESCRIPTION OF THE INVENTION

Figure 1:
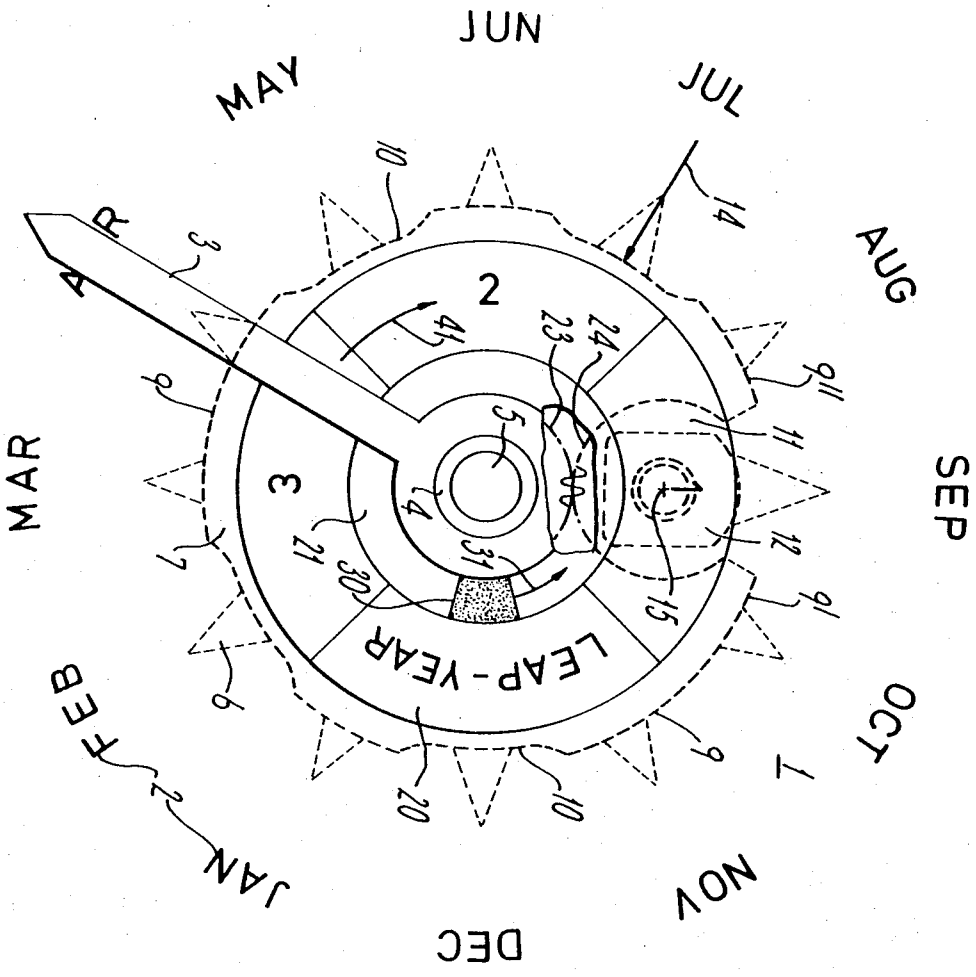
FIG. 1 is a top plan view of the month indicator and of the four year cycle indicator according to a first variant of the invention.

The description in detail of the operation of a perpetual calendar mechanism will not be given here. The interested reader may find for instance in the book by B. Humbert entitled "Modern Calendar Watches" all useful information necessary to the understanding of the operation of such a mechanism (Edition Scriptar S. A. Lausanne, 1954). It is noted however that a perpetual calendar watch does not require any manual correction of the data display at the end of months having less than 31 days. Furthermore, every four years with the arrival of the leap-year and the month of February, the watch will display the FIG. 29 before indicating the 1st of March. The date display (not shown in the drawings accompanying this description) may be effected by means of a hand or by means of a disc for which the numerical indications appear one after the other through a window in the dial. The hand or the disc normally making one revolution in 31 days is controlled by a multiple rocking lever of which one of the beaks acts as follower to a cam making one revolution in twelve months and which will be described hereinafter.

FIG. 1 is a top plan view of a first variant of the invention. On dial 1 of the watch are printed indications 2 relative to the months of the year and spread out around the circumference. The month hand 3 is press fitted onto the month star pipe 4 which pivots on stud 5.

Figure 2:
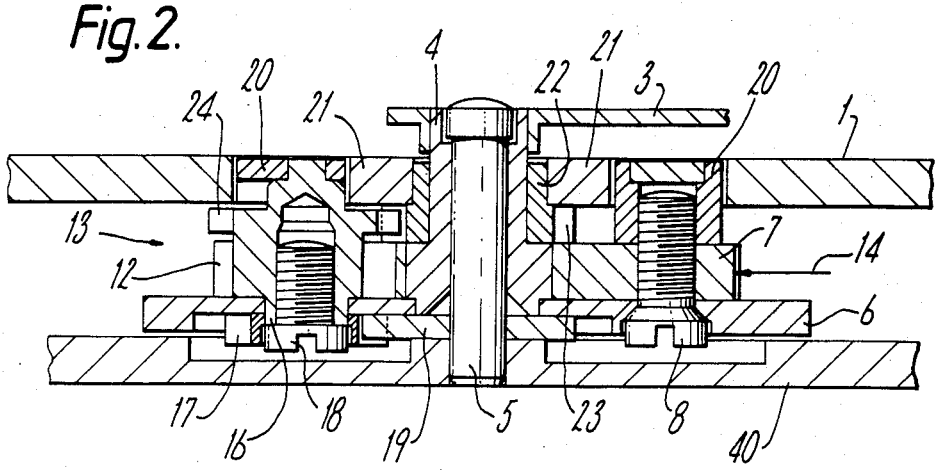
FIG. 2 is a cross-section of the mechanism as shown in FIG. 1.

If reference is now had to FIG. 2 which is a cross-section of FIG. 1 it will be seen that stud 5 is fixed to the base plate of the calendar 40, for example by press fitting. On pipe 4 is pressed star 6 which turns thus freely about stud 5 which latter serves as a pivot axle. A month cam 7 is fixed on the star by means of screws 8. Applied to this cam as a follower is one beak of a multiple rocking lever for slaving the date hand to the current month as described hereinabove. The beak of the rocking lever is symbolically shown on FIGS. 1 and 2 by arrow 14 while the slaving mechanism of the date indicator has not been shown. As best seen on FIG. 1 the month star 6 bears twelve teeth and cam 7 presents full radius sectors 9 corresponding to 31-day months and shallow notches 10 corresponding to 30-day months. The cam 7 further provides an opening 11 situated between the full radius sectors corresponding to the months of January (9′) and March (9″). In the opening is placed the year cam 12 which is shown as a small rectangular block forming part of a rotatable assembly 13 pivoting on star 6. It is apparent that three sides of the rectangle are at equal distance from the pivot point 15 while the fourth here presented in the form of arc of a circle is at a greater distance therefrom. In the month of February the beak 14 will be facing opening 11. If at this moment one of the three sides the closest to the center is turned towards the exterior of opening 11 the beak 14 will obtain its maximum penetration, this corresponding to a month of February having 28 days. If on the contrary, the side in the form of an arc of a circle is directed towards the exterior of opening 11 as shown on FIG. 1, the beak 14 will only be able to penetrate to a depth intermediate between a shallow notch 10 and a side closest to the pivot axis of the year cam 12; this corresponding to a February having 29 days. In the first case considered hereinabove, the date indicator will shift directly from the 28th of February to the 1st of March while in the second case representing a leap year the passage to the 1st of March will be made after the 29th of February. Thus, there is a succession of three normal years followed by a leap-year.

It is thus necessary that cam 12 make one revolution in four years, this being brought about in the following manner: cam 12 is provided with a pipe 16 having a squared-off surface and which pivots freely in the star 6. On the squared-off portion is adjusted a Maltese cross 17 having four openings and solidly fixed to the year cam 12 by screw 18. As will be seen in FIG. 3, a year finger 26 is pressed onto stud 5. When the star turns finger 26 thus remains immobile. As star 6 effects one revolution per year, it will be understood that the Maltese cross 17 and thus the year cam 12 which is coupled thereto will effect only a quarter of a revolution during the same time lapse. Thus every four years the side of cam 12 in form of arc of a circle will come to be located before opening 11 as shown on FIG. 1.

As has already been mentioned, this invention makes use of the state of the art which has just been described in order to control a four-year cycle indicator by the rotatable assembly 13 pivoting on the star and of which the year cam 12 forms a part.

A first variant of the invention will now be explained having reference to FIGS. 1, 2 and 3. Initially, there will be noted a first ring 20 which is fixed to the month star 6. It will be seen that screws 8 are retained by threading arranged in the ring 20 in a manner such that when they are tightened, ring 20, cam 7 and the star 6 together form a rigid assembly which effects one revolution per year and which drives in its rotation the month hand 3, said hand being solidly assembled with a pipe 4 itself fixed to star 6.

The mechanism further provides a second ring 21 arranged to turn freely within the first ring 20. The second ring is force fitted onto pinion 22 freely mounted on pipe 4. The teeth 23 of pinion 22 mesh with teeth 24 borne on rotatable assembly 13 journalled on star 6. The second ring constitutes the four-year cycle indicator controlled by rotatable assembly 13.

Figure 3:
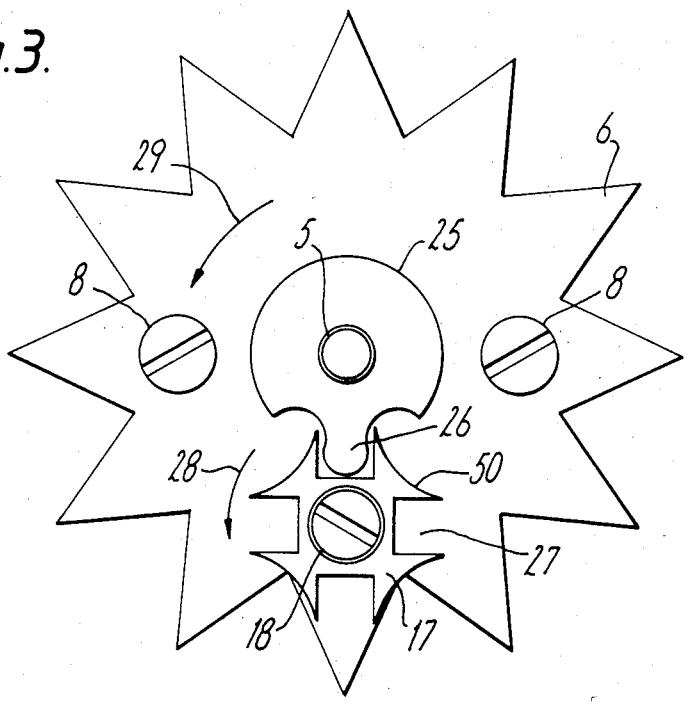
FIG. 3 is a view from below of the mechanism according to FIG. 2 when the calendar base plate has been removed.

During most of the months of the year, that is from February to September, the concave rounded portion 50 of one tooth of the Maltese cross 17 is in contact with the circular portion 25 of finger 26 (see FIG. 3). The Maltese cross is thus held fixed relative to the star. During this lapse of time accordingly, the second ring 21 will turn in synchronism with the first ring 20 because of the coupling existing between teeth 24 and pinion 22.

From the month of October on, the finger 26 begins to penetrate into the tooth gap 27 of the Maltese cross 17. Rotatable assembly 13 is then driven in rotation in the sense of arrow 28 if the star turns in the sense of arrow 29. During its rotation, that is to say between the months of November and December, the Maltese cross occupies the position shown on FIG. 3. In the month of January, the tooth gap 27 of the Maltese cross 17 leaves finger 26 and in February the concave portion 50 of the Maltese cross is again found in contact with the circular portion 25 of finger 26. Thus, the Maltese cross 17 and the rotatable assembly 13 which is coupled thereto will have made a quarter of a revolution in the sense of arrow 28 and through teeth 24 will have driven pinion 22 and the second ring 21 through a quarter of a revolution in the inverse sense.

In a practical arrangement and as may be seen from FIG. 1, the visible faces of rings 20 and 21 are arranged in the same plane as the visible face of dial 1. The visible face of the first ring will be divided into four segments, the first bearing the indication "1", the second the indication "2", the third the indication "3" and the fourth the indication "BISSEXTILE" (leap-year). An index marker 30 is arranged on the visible face of the second ring 21. From the month of February to the month of September, the month hand 3, the first ring 20 and the second ring 21 turn in synchronism in the sense of arrow 41. The index marker 30 remains centered permanently in front of the segment marked "BISSEXTILE" (leap-year) of the first ring 20, indicating thereby the indicated year to be a leap-year. From the time that hand 3 reaches the month of October, the second ring 21 begins to turn in the sense opposite to that of the first ring 20 and in the sense of arrow 31. When hand 3 has reached the month of February the index marker 30 will be found centered on the indication "1" indicating thereby a first non leap-year.

It will be noted in respect of this arrangement that hand 3 may be replaced by an index marker placed on the first ring 20, this index assuming thus the role of month indicator.

A second variant of the invention will now be described having reference to FIGS. 4 and 5.

Figure 5:
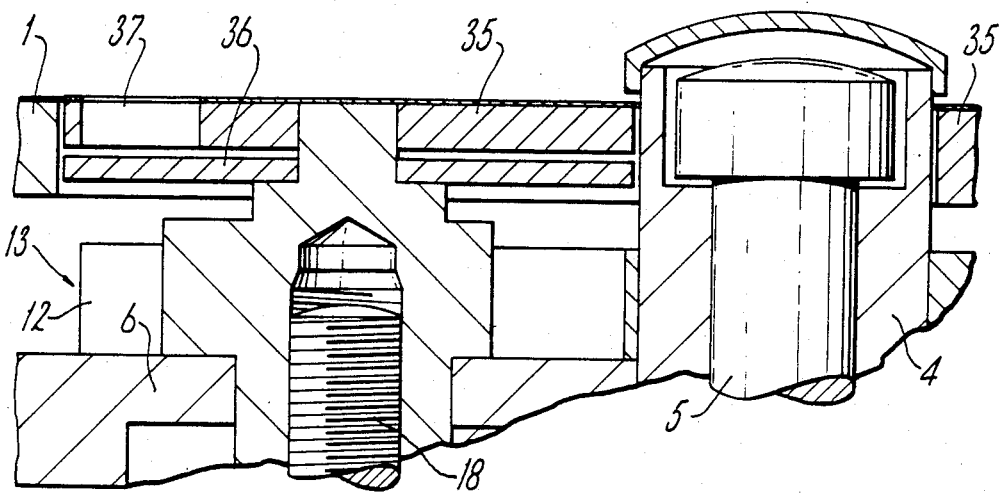
FIG. 5 is a partial cross-section of the mechanism as shown in FIG. 4.

On FIG. 5 which is a partial section of the mechanism according to this second version, there will be seen the month star 6 and the rotatable assembly 13 pivoting on the star. Such rotatable assembly also includes a year cam 12 and a Maltese cross (not shown) which is attached thereto by means of screw 18. This arrangement is the same as that which has been explained in respect of the FIGS. 1–3. On the month star 6 (fixed to pipe 4) is placed a single ring 35. The assembly thus formed turns on stud 5.

In this variant, the year cam 12 is surmounted by a year indicator disc 36 which is press fitted and turns thereby with the cam. Ring 35 is provided with an opening 37 through which may appear information borne by the disc. According to the explanations which have been given hereinabove, disc 36 will make one revolution in four years and will show four different segments through opening 37, the changing of the segment taking place over four months (October to January) in a manner such that the year indication of the current year appears clearly when one arrives at the month of February. Thus the year indicator disc turns on its axis with each change of year and revolves about stud 5 in one year since it is driven by star 6 and ring 35 fixed to said star.

Figure 4:
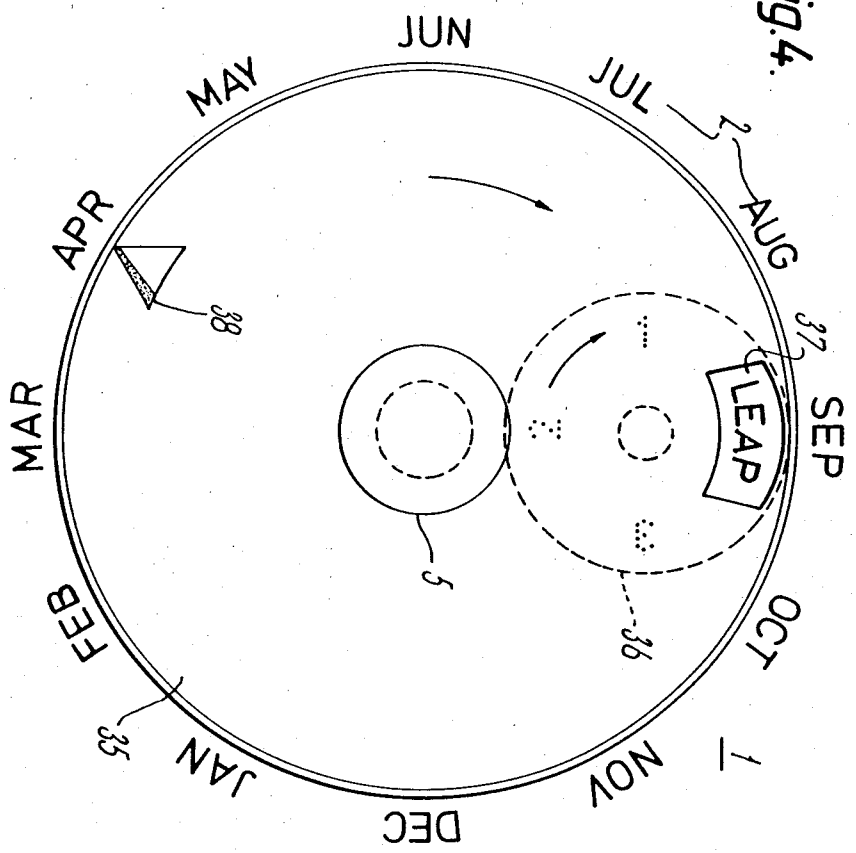
FIG. 4 is a top view of the month indicator and the four year cycle indicator according to a second variant of the invention.

FIG. 4 is a top-view of the indicator according to this second variant. This visible surface of ring 35 is at the same level as the top surface of dial 1 of the watch. This dial bears month indications 2. The month indicator is here an index marker 38 placed on the ring, but this could be also a hand fitted onto pipe 4 (see FIG. 5) as was the case in the first variant described hereinabove. Disc 36 provides four information items spread apart an equal distance from one another of which three are relative to non leap-years and marked "1", "2" and "3" respectively and of which the fourth concerns a leap-year and is marked "BIS". One of these information items appears in opening 37, then changes at each revolution of the index marker 38.

It will be understood that this second variant benefits directly from the rotation of the rotatable assembly 13 journalled on star 6 to display the current year since it is no longer necessary to equip the mechanism with a pinion meshing with teeth as in the first variant. However, this second variant necessitates a ring 35 of large diameter in order that indications borne on disc 36 may be readable in the opening. This difficulty may be avoided if one replaces numbers and letters by colour markings, for instance red for the leap-year and white, black and blue for the non leap-years.

In this second variant, disc 36 may be replaced by a hand of which the axis is fixed to rotatable assembly 13 and passes through ring 35. In this case indications "1" "2" and "3" and "leap-year" would be directly placed on ring 35.

What is claimed is:

1. A perpetual calendar mechanism for a timepiece comprising a month start effecting one revolution per year, a month cam fixed to the month star and exhibiting full radius segments corresponding to thirty-one day months, shallow notches corresponding to thirty day months and an opening between the full radius segments corresponding to January and March, a rotatable assembly journalled on the month star and including a year cam arranged to effect one revolution every four years, said year cam exhibiting four sides which appear successively in said opening, a month indicator, a four year cycle indicator said cycle indicator being controlled by said rotatable assembly, and a first ring fixed to the month star, the month indicator comprising a hand borne by a pipe fixed to said star, and the four-year cycle indicator comprising a second ring fixed to a pinion journalled on said pipe, said second ring being able to turn freely within said first ring and said pinion being arranged to mesh with teeth borne by the rotatable assembly journalled on the star.

2. A perpetual calendar mechanism as set forth in claim 1 wherein the first and second rings exhibit visible surfaces substantially coplanar with the visible surface of the timepiece dial, the visible surface of the first ring being divided into four sectors the first three of which bear information concerning normal years and the fourth bears information concerning leap-year, the visible surface of the second ring bearing an index marker which passes from one sector to the next with each full revolution of the month hand.

3. A perpetual calendar mechanism for a timepiece comprising a month start effecting one revolution per year, a month cam fixed to the month star and exhibiting full radius segments corresponding to thirty-one day months, shallow notches corresponding to thirty day months and an opening between the full radius segments corresponding to January and March, a rotatable assembly journalled on the month star and including a year cam arranged to effect one revolution every four years, said year cam exhibiting four sides which appear successively in said opening, a month indicator, a four year cycle indicator said cycle indicator being controlled by said rotatable assembly, and a ring fixed to the month star, the month indicator comprising an index placed on the periphery of the ring, and the four-year cycle indicator comprising a disc located under the ring and fixed to the rotatable assembly, said ring having an opening through which appears information borne by the disc.

4. A perpetual calendar mechanism as set forth in claim 3 wherein said ring exhibits a visible surface substantially coplanar with the visible surface of the timepiece dial said disc bearing four items of information three of which concern normal years and the fourth concerning leap-year, said information items appearing successively in said opening with each full revolution of the month indicator index.

* * * * *